US005429059A

United States Patent [19]

Wagoner et al.

[11] Patent Number: 5,429,059

[45] Date of Patent: Jul. 4, 1995

[54] RETROFITTED COAL-FIRED FIRETUBE BOILER AND METHOD EMPLOYED THEREWITH

[75] Inventors: Charles L. Wagoner; John P. Foote, both of Tullahoma, Tenn.

[73] Assignee: The University of Tennessee Research Corporation, Knoxville, Tenn.

[21] Appl. No.: 66,783

[22] Filed: May 24, 1993

[51] Int. Cl.[6] ..... F23B 7/00

[52] U.S. Cl. ..... 110/234; 110/263; 110/264; 110/347; 122/136 R; 122/149

[58] Field of Search ..... 122/149, 136 R, 51; 110/347, 263, 264, 234

[56] References Cited

U.S. PATENT DOCUMENTS

| | | | |
|---|---|---|---|
| 4,381,718 | 5/1983 | Carver et al. | 110/347 |
| 4,501,204 | 2/1985 | McCartney et al. | 110/264 |
| 4,796,547 | 1/1989 | Kobayashi et al. | 110/263 |
| 4,989,549 | 2/1991 | Korenberg | 122/149 |
| 5,161,488 | 11/1992 | Hatter | 122/149 X |

*Primary Examiner*—Edward G. Favors

*Attorney, Agent, or Firm*—Rosenblatt & Associates

[57] ABSTRACT

A coal-fired firetube boiler and a method for converting a gas-fired firetube boiler to a coal-fired firetube boiler, the converted boiler including a plurality of combustion zones within the firetube and controlled stoichiometry within the combustion zones.

36 Claims, 9 Drawing Sheets

RETROFITTED COAL-FIRED FIRETUBE BOILER AND METHOD EMPLOYED THEREWITH

This invention was made with government support under DE-AC22-87PC79653 awarded by the U.S. Department of Energy. The government has certain rights in this invention.

This invention relates to boilers, such as steam-generating boilers, and particularly to the retrofitting of gas-fired boilers to coal-fired boilers.

Currently there is a very large number of gas-fired boilers which are operational. In a typical gas-fired boiler the fuel combustion takes place in a firetube with the walls of the tube being heated by the combustion. Water is circulated past the outer wall of the tube and in heat transfer relationship to the walls of the firetube, so that the water is converted to steam. In a typical boiler, the heated gases from the combustion are caused to flow along several additional tubes which are contained within the boiler, with the external walls of these additional tubes being also exposed to the water so as to increase the efficiency of heat transfer from the hot combustion gases to the water and thereby increase the efficiency of the steam formation function.

Gas-fired boilers commonly are fueled by means of natural gas, propane or other gaseous fuel, or by oil (which is mixed with air to generate a type of mist that is injected into the firetube). In Public Law 99-190, Laws of the 99th Congress-1st Session, it was mandated "to rehabilitate and convert current steam generating plants at defense facilities in the United States to coal burning facilities in order to achieve a coal consumption target of 1,600,000 short tons of coal per year above current consumption levels at Department of Defense facilities in the United States by fiscal year 1994: Provided, That anthracite or bituminous coal shall be the source of energy at such installations: Provided further, That during the implementation of this proposal, the amount of anthracite coal purchased by the Department shall remain at least at the current annual purchase level, 302,000 short tons." Successful completion of this mandate, at minimum cost, dictates that there be a conversion of the existing gas-fired boilers to coal-fired boilers.

Conversion of a firetube boiler to a coal-fired boiler is complicated by reason of the relatively short length of the firetube. Combustion of a gas or oil fuel in a boiler requires less lineal distance for the combustion reaction than for the combustion of coal as the fuel. This is due in major part to the fact that conversion of the carbon content of the coal requires a longer time period than does the conversion of the carbon content of the gas or oil fuels. Consequently, firetube boilers have a smaller combustion volume that coal-fired boilers. Further, in firetube boilers, there is a high rate of heat loss to the water cooled walls of the tubes within the boiler, which rate of heat los adversely affects the combustion rate of coal burned in the same firetube.

Goals for coal-fired boilers include (1) greater than 99 percent carbon conversion efficiency, (2) greater than 80 percent boiler efficiency, (3) $NO_x$ emission less than 0.7 lb/MBtu, and (4) turndown ratio of 3-to-1.

In accordance with the present invention, there is provided a system by means of which an industrial-type firetube boiler may be retrofitted to convert it to a coal-fired boiler. By means of the present invention, this conversion is effected economically and the overall efficiency of the boiler operation using coal fuel (as measured by the cost per pound of steam generated) is equal to or greater than the efficiency of the same boiler operated as a gas or oil-fired firetube boiler.

The present invention includes replacement of the gas or oil injector unit for a firetube boiler with a novel coal injector unit, provision of a dense, constant, and controllable feed stream of finely divided coal, establishing and maintaining an initial reducing environment within the inlet region of the tubular combustion chamber of about 0.55 stoichiometry while developing an overall combustion stoichiometry of about 1.2 over the length of the combustion chamber, and dividing the combustion air admitted to the combustion chamber into multiple streams, each of which is introduced to the combustion chamber at physically separated locations along the length of the combustion chamber.

In particular, in accordance with the present invention, a coal is comminuted to a micronized state, fed from a storage vessel via a gyratory feed screen to an accumulation plenum wherein the finely divided coal is fluidized by an inert gas, and in turn fed via a feed screw to a conduit that leads to the inlet of a specially designed annular eductor which is located adjacent the inlet to the coal injector unit (i.e., an inlet nozzle to the combustion chamber). Motive air for educting the dense coal stream and injecting the mixture of coal and air into the inlet end of the inlet nozzle is provided by a pump means. The feed screw does not control the feed rate of the coal, but rather, the quantity of coal admitted to the combustion chamber is a function of the pressure (volume) of the air employed as the educting fluid, assuming a given constant feed supply of coal to the eductor. The volume of motive air is chosen to represent about 15% of the air required for combustion of the coal at the selected feed rate of the coal.

The inlet nozzle is of special design, including a first section into which the mixture of coal and motive air expands to supersonic velocity, thereby enhancing the mixing of the finely divided coal with the air to establish an efficiently combustible mixture. This mixture thereafter passes through a series of shocks within the nozzle where the air velocity decreases and the static pressure rises to match the burner operating pressure. Static pressure in the suction section of the eductor ranges as a function of the motive air pressure and the coal flow rate. For a given motive air pressure and coal flow rate, the suction pressure is constant, so for a coal feed line with repeatable pressure drop characteristics, the coal flow rate can be controlled by varying the motive air pressure.

Following the first-stage eductor, the inlet nozzle is provided with a second section within which initial combustion takes place under reducing conditions, such conditions having been found to limit the formation of $NO_x$. This second section includes a refractory-lined annular wall which is designed to define an annular inlet for the addition of secondary combustion air to the combustion chamber. This inlet preferably is provided with angular vanes which impart a clockwise swirl to the combustion air entering the initial combustion zone. This air movement stabilizes the primary flame. Approximately 30% of the required combustion air is admitted to the combustion chamber via this secondary air inlet.

The remainder of the required combustion air is admitted to the combustion chamber downstream from the initial combustion zone at a location adjacent the downstream end of the firetube. It has been found by the present inventors that this final portion of the combustion air should be introduced to the firetube via a series of jets which are disposed about the annular wall of the firetube and which are angled at about 20 degrees with respect to the diameter of the firetube such that the air enters the firetube about its inner circumference in a series of streams which create a swirl which is counter to the swirl imparted to the secondary combustion air by the vanes in the inlet nozzle. This counter swirl has been found to enhance the mixing of the final portion of the combustion air with the flame, thereby enhancing the destruction of $NO_x$ which may have been formed during the combustion of the coal fuel.

Within the primary combustion zone (between the nozzle and the location of the jets adjacent the downstream end of the firetube), it has been found to be most efficient to maintain the stoichiometry of the combustion reaction at about 0.55, but with the overall stoichiometry being established at about 1.20. Further, within this combustion zone, the firetube is provided with a refractory lining which has been found useful in isolating the reducing gases from the metal wall of the firetube, thereby minimizing both the potential for corrosion and excessive cooling of the combustion gases.

It therefore is an object of the present invention to provide a system for the retrofitting of a firetube boiler to a coal-fired boiler.

It is another object to provide for the conversion of a firetube boiler to a coal-fired boiler wherein the coal-fired boiler has a steam generation efficiency equal to or greater than the steam generation efficiency of the same boiler fired by gas or oil.

It is another object to provide a method for the firing of a firetube boiler with coal.

Further objects and advantages of the invention will be recognized from the following description, including the claims and the drawings in which:

In accordance with the present invention, an industrial type firetube boiler is retrofitted for fueling by coal at a carbon conversion efficiency of at least about 99%, emissions of $NO_x$ of less than about 0.7 lb/million Btu, and a turndown ratio of at least about 3:1. The term "$NO_x$", as used herein refers to the sum total of all oxides of nitrogen formed during the combustion of the coal fuel in the retrofitted boiler, such oxides being measured at the flue gas exhaust of the boiler. "Turndown ratio" refers to the ability of the boiler to be operated continuously and its output in Btu's being regulatable between a maximum output at the maximum fuel burn rate, to a lower value which is at least two-thirds less than the maximum output. Turndown ratio is measured by the fuel burn rate.

Figure 1:
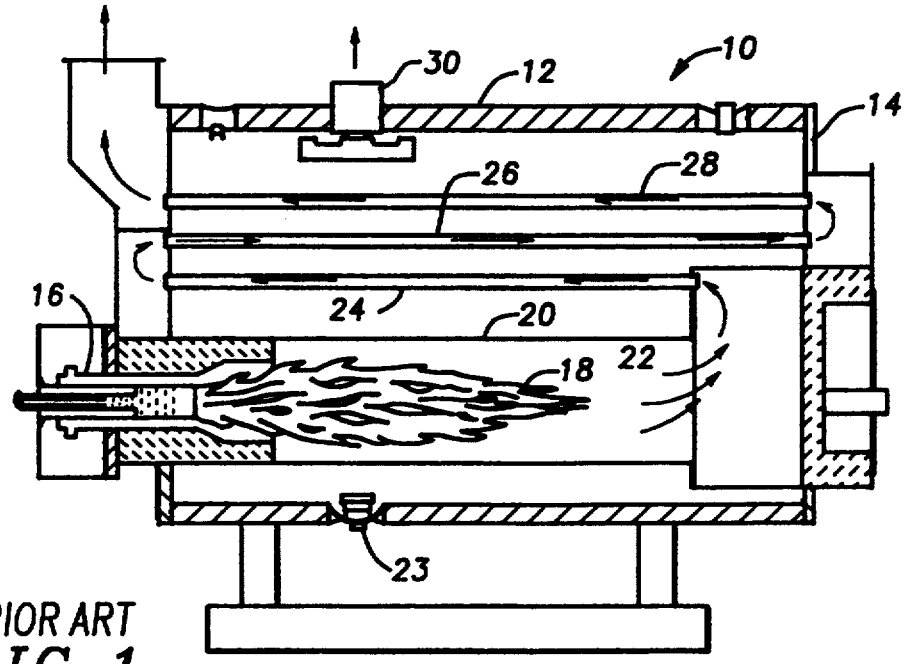
PRIOR ART FIG. 1
FIG. 1 is a schematic representation, part in section, of a typical firetube boiler of the prior art.

As depicted in FIG. 1, a typical firetube boiler 10 of the prior art comprises a cylindrical housing 12 having one of its ends closed as by a cap 14 and having its opposite end fitted with a forced draft burner 16. Propane, natural gas, oil or other combustible gas or liquid is introduced to the burner along with combustion air to develop a flame 18 within the firetube 20. Heat from the flame is transferred through the wall 22 of the firetube to water which enters the housing via an inlet 23 and is circulated within the housing 12 and past the wall 22. The combustion gases from the firetube are further caused to circulate through a series of further tubes 24, 26 and 28 as indicated by the several arrows in FIG. 1. By this means, the water circulating about the several tubes is eventually converted to steam which exits the boiler via an outlet valve 30. FIGS. 2A, 2B, 2C and 2D depict, in cross-section, those tubes within the boiler which are involved in each of the several passes of the hot combustion gasses along the longitudinal dimension of the boiler housing. In these Figures, the solid black areas represent those tubes which are involved in the four depicted passes, the first of which is the firetube itself and the remaining three being the several additional heat transfer tubes indicated generally by the numerals 24, 26 and 28. As will appear more fully hereinafter, the present invention does not materially alter the configuration of the passes of the hot gases as depicted in FIGS. 1 and 2A–2D.

Figure 3:
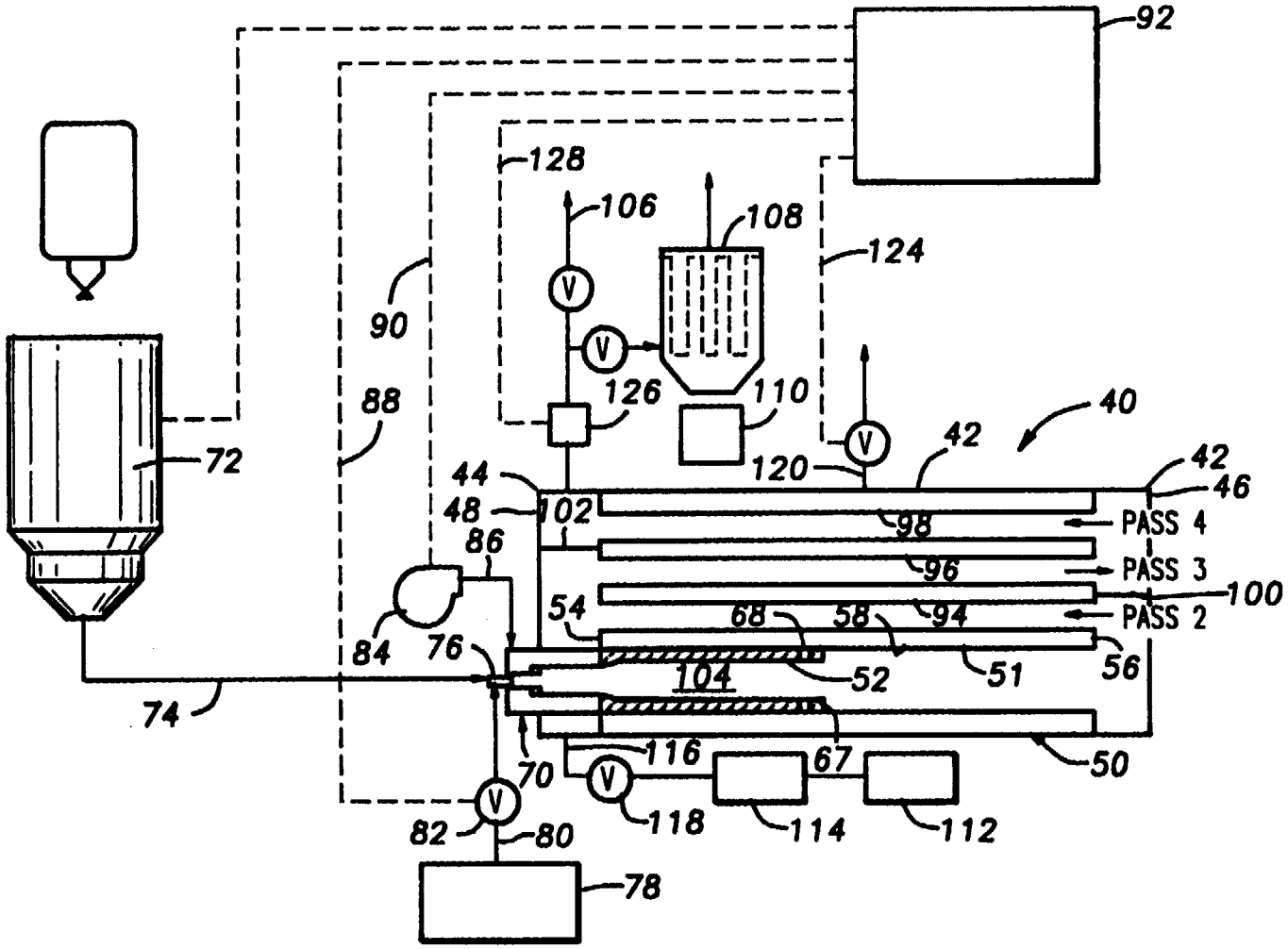
FIG. 3 is a schematic representation, part in section, of a firetube boiler which has been retrofitted in accordance with the present invention.
Figure 7:
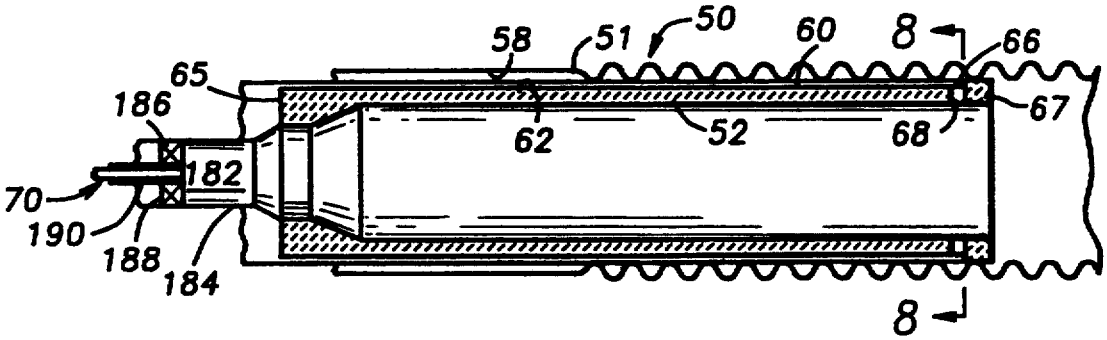
FIG. 7 is a schematic representation, part in section, of a firetube of a firetube boiler which has been retrofitted in accordance with the present invention and depicting the several locations for the introduction of fuel and combustion air to the firetube as per the present invention.
Figure 8:
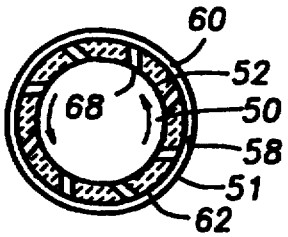
FIG. 8 is a cross-sectional view taken generally along the line 8—8 of FIG. 7 and depicting the angularity of the several air inlets for secondary combustion air to the firetube.

As depicted in the several Figures, with particular reference to FIGS. 3 & 7, a retrofitted boiler 40 embodying various of the features of the present invention, comprises an outer housing 42 which is generally tubular in geometry and which has its opposite ends 44 and 45 closed gas-tight as by means of end caps 46 and 48. Internally of the housing 42 there is mounted a firetube 50 made up of a cylindrical metal tube 51 within the interior of which there is provided a refractory liner 52 that extends from an inlet end 54 of the firetube 50 along the length dimension of the firetube to terminate at about the midpoint of the length of the firetube. The refractory liner 52 is concentric with and disposed contiguously to the inner wall 58 of the metal tube 56, except for an annular channel 60 (see FIG. 7) which is defined between the outer surface 62 of the refractory liner 50 and the inner surface 58 of the metal tube 51, such channel extending from the inlet end 65 of the refractory liner to a terminating location adjacent the downstream end 67 of the liner. This channel 60 serves as a passageway for the movement of secondary combustion air from the inlet end of the firetube to the terminating location of the channel. The terminal end 66 of the channel is provided with a plurality of inlet jets 68 each of which extends through the thickness of the refractory liner and provides a continuation of the channel 60 and further serves to permit the introduction of secondary combustion air from the channel into the interior of the firetube. In a preferred embodiment as depicted in FIG. 8, each jet is oriented at an angle of about 20° with respect to the diametral dimension of the firetube so that the combustion air from the several jets disposed about the circumference of the firetube (typically eight such jets) direct the incoming secondary combustion air into the firetube in a swirling motion, the direction of such swirl being counter to the swirl of the primary flame in the firetube.

Stated generally, the apparatus depicted in the several Figures, and particularly FIG. 3, further includes an inlet nozzle 70 provided on the inlet end 65 of the firetube. Coal from a storage hopper 72 is fed through a feed pipe 74 from the hopper to an eductor 76 provided as a part of the inlet nozzle 70. Motive air for the eductor 76 is provided by means of a pumping device or pump means 78 which serves as a source of pressurized air. This pressurized air is fed via a conduit 80 to the eductor 76. A flow control device or valve means 82 is interposed in the conduit at a position between the pump means and the eductor for providing control over the pressure of the air entering the eductor. Primary combustion air is introduced to the firetube as by a blower device or fan means 84 and a conduit 86. The fan means 84 is independently controlled to permit selection of the amount of combustion air introduced to the firetube by the fan means. Each of the means employed for supplying pressurized air to the eductor, and the operation of the fan means is controlled by appropriate control line connections 88 and 90, respectively, to a central controller 92 such as a microprocessor-based system controller.

Figure 2A:
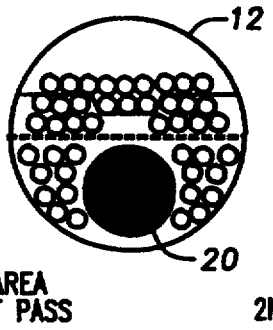
PRIOR ART FIG. 2A
FIGS. 2A, 2B, 2C and 2D are schematic cross-sectional views of a firetube boiler of the type depicted in FIG. 1 and showing the details of four passes of combustion gases through the several tubes of the boiler, the shaded areas of each of these Figures identifying the tube or tubes involved in each depicted pass.
Figure 2B:
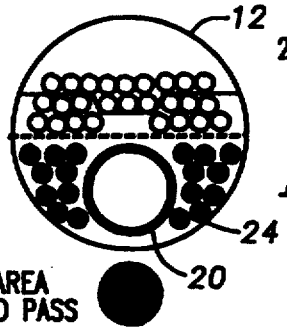
PRIOR ART FIG. 2B
Figure 2C:
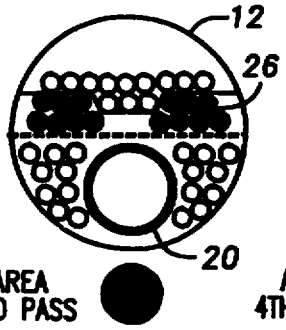
PRIOR ART FIG. 2C
Figure 2D:
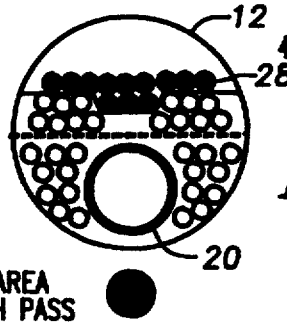
PRIOR ART FIG. 2D

Within the housing 40, in addition to the firetube 50, there is provided a plurality of heat tubes that extend just short of the length dimension of the internal length of the housing. These several tubes 94, 96 and 98 are divided into groups as by means of separators 100 and 102 such that heated gases from the combustion chamber 104 of the firetube 50 are caused to make multiple passes along the length of the housing prior to their escape from the boiler through a flue gas stack 106. The passage of the combustion mixture along the length of the firetube is designated as "Pass 1" in the depicted boiler (see FIGS. 2A–2D and 3). The tubes depicted as solid black in FIGS. 2A–2D comprise the tubes along which the hot combustion gases flow following their exit from the firetube and are designated as "Pass 2". Similarly the tubes 96 and 98 which are involved in further flow of the hot gases along the length of the housing 42 are depicted in FIG. 2C and 2D, respectively, as "Pass 3" and "Pass 4". From "Pass 4", the combustion gases pass through the flue gas stack 106 and either to the ambient atmosphere or through a filter baghouse 108 and then to the ambient atmosphere. Ash collected in the baghouse 108 drops to an ash receptacle 110 for subsequent disposal. Water from a source 112 is conveyed as by a pump 114, through a conduit 116 that includes a flow control valve 118, into the housing 42 where the water is caused to flow in heat exchanging relationship to the several heated tubes disposed within the housing such that the water is converted to steam within the boiler. This steam exits the boiler through a conduit 120 which is provided with a control valve 122 that is, in turn, connected by a control line 124 to the central controller 92.

As depicted, in a preferred embodiment, an oxygen sensor 126, such as a conventional automotive oxygen sensor is interposed in the flue gas stack 106 such that the sensor is in position to detect the presence of oxygen in the flue gas exiting the boiler. By means of a control line 128, this oxygen sensor is connected to the central controller 92 to provide a means for the signal from the oxygen sensor to be fed to the controller and employed by the controller as an indicator of the excess air level in the boiler. Based upon the signal from the oxygen sensor, the central controller 92 controls the operation of the fan means 84 to introduce more or less combustion air to the combustion chamber 104 of the firetube 50. The oxygen concentration in the flue gas is maintained at the desired level for maximum combustion efficiency by a control loop. This control loop is unique in that the oxygen measurement is effected by means of an inexpensive automobile oxygen sensor available off-the-shelf from an auto parts store. The sensor has a built-in resistance heater which is powered by a DC power supply to maintain the sensor at its correct operating temperature. The output signal from the sensor is nonlinear and has an amplitude in the millivolt range. The sensor is calibrated and the resulting polynominal coefficients are used to calculate a direct readout of the flue gas oxygen content. A special filter fabricated from Gore-Tex filter media is employed to prevent fouling of the sensor by flue gas contaminants. Oxygen concentration in the flue gas is used as the process feedback to a PID control loop that controls the combustion air blower speed. A variable speed AC motor drive changes the frequency and amplitude of the three-phase, 208 volt, power to the blower motor based on the 4/20 milliamp signal from the oxygen controller. The blower speed regulates the amount of air flowing into the firetube and thus the oxygen content in the flue gas. This technique of controlling combustion air flow provides the advantages of high fuel economy in the boiler, as well as electrical power savings, since the blower motor is running at the minimum speed necessary to provide the required air flow. Dampers are not used.

Figure 4:
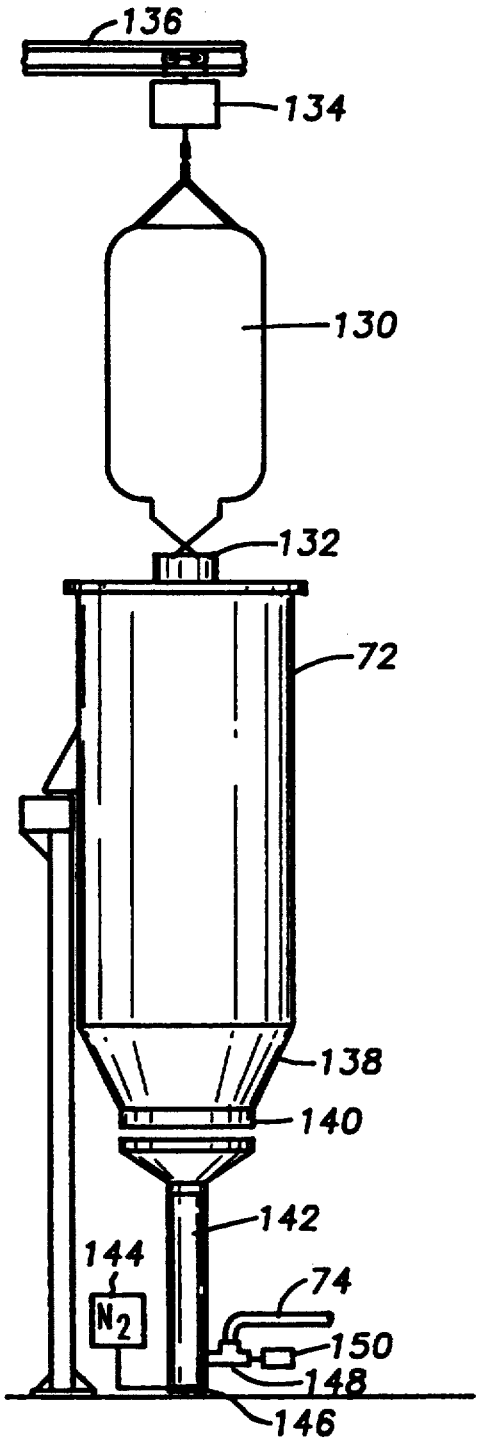
FIG. 4 is a schematic representation of a coal storage and feed system for supplying finely divided coal to the eductor unit of the present system.

In accordance with one aspect of the present invention, as depicted in FIG. 4, finely divided coal which serves as the fuel for the retrofitted boiler of the present invention, is stored in a hopper 72. In the depicted embodiment, the coal is dumped from a shipping bag 130 into the top 132 of the hopper. Conveniently, the coal shipping bag is hoisted above the hopper as by means of a hoist 134 mounted on a jib crane 136. The bottom region or wall 138 of the hopper preferably is of an inverted cone geometry, such cone serving to support the coal within the hopper while provided for the free flow of the coal from the hopper through a gyrating hopper discharger or discharge outlet 140 into a discharge plenum 142 that is disposed beneath the hopper and in position to receive the coal from the gyrating discharger. Preferably, the coal disposed within the plenum 142 is supported on a Gore-Tex fluidizing pad and fluidized as by an inert gas 144, such as nitrogen, that is introduced to the plenum adjacent the lowermost end 146 thereof. Adjacent the lowermost end 146 of the discharge plenum there is provided a feed conveyor device or auger means 148, such auger being driven by a motor 150 operatively connected to the auger. Operation of this auger 148 serves to move the finely divided coal from the plenum along a feed pipe 74 to the eductor 76 (See FIGS. 3,5 and 7).

Figure 5:
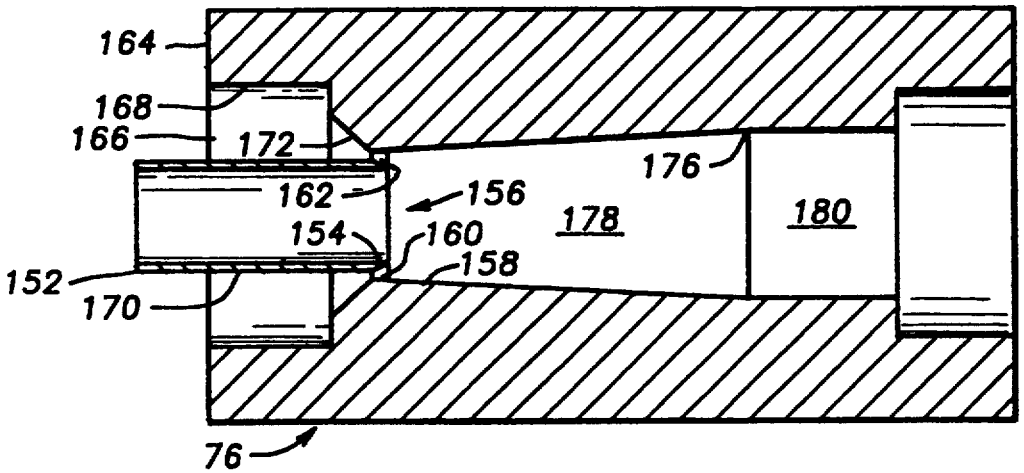
FIG. 5 is a schematic cross-sectional representation of a coal feed eductor unit and depicting various of the features of the present invention.

In accordance with another aspect of the present invention, as depicted in FIG. 5, the eductor 76 which is employed to introduce a combination of finely divided coal and combustion air into the inlet nozzle 70 (see FIG. 7) includes a coal delivery tube 152, an end 154 of which terminates in the throat 156 of the eductor 76. At its terminus 154, the coal delivery tube of the depicted embodiment is chamfered about its outer circumference, and spaced inwardly and apart from the inner annular wall 158 of the throat 156 of the eductor. A spider device such as a spider means 160 is provided to maintain the annular spacing between the terminus of the coal delivery tube and the inner wall of the throat thereby developing an open annulus 162 for the movement of motive air therethrough. High pressure motive air from a source 78 (See FIG. 3) of pressurized air is fed into the eductor via an annular passageway 162 formed between the inner wall 168 of the inlet end 164 of the eductor, such passageway being disposed concentrically of the coal delivery tube 152, and the outer wall 170 of the delivery tube. In the depicted embodiment, the pressurized motive air is accelerated by reason of the moving air being forced into the eductor past a beveled annulus 172 defined in the eductor upstream of the annulus 162. In a preferred embodiment, the chamfer on the coal delivery tube is chosen to be about 30 degrees, and the bevel 172 is chosen to be about 45 degrees, both angles being relative to the longitudinal centerline of the eductor. Thus, the incoming pressurized motive air is caused to be accelerated such that its flow rate past the terminus 154 of the coal delivery tube creates a vacuum at the terminus. This vacuum functions to draw finely divided coal from the coal delivery tube and convey it into the throat 156 of the eductor. Further, the change in direction of the incoming motive air from a generally laminar flow in the annular passageway 166 to a highly turbulent flow immediately downstream of the terminus of the coal delivery tube results in good mixing of the coal and air to create an excellent combustion mixture.

As seen in FIG. 5, the throat 156 of the eductor increases in internal circumference from a location adjacent the terminus of the coal delivery tube to a location 176 spaced downstream of the delivery tube to define an initial coal-air mixing chamber 178. By reason of this increasing circumference, there is an increasing volume of the initial mixing chamber 178 in a direction downstream from the terminus of the coal delivery tube. As the mixture of motive air and coal enters this initial mixing chamber and moves along the length thereof, the air expands and preferably achieves supersonic velocity, thereby creating further mixing of the coal and air. The coal-air mixture passes through a series of shocks in the diverging section of the eductor where the static pressure rises to match the exit condition in the combustor.

As best seen in FIGS. 3 and 7, the outfeed of mixed coal and air from the eductor 76 is introduced into a first section 182 of a primary combustion chamber 184. Concurrently with the introduction of the coal-air mixture to this first section 182, primary combustion air from a source 84 thereof is introduced to the first section through a set of angled vanes 186 which are disposed in an annular opening 188 formed between the outer wall 190 of the tail end of the eductor and the inner wall 192 of the first section 182 of the primary combustion chamber. By this means, the primary air is mixed well with the coal-air mixture from the eductor and there is imparted a stabilizing swirl to the combustion flame which begins to form in the first section 182 of the primary combustion chamber. First and second annular beveled surfaces 194 and 196, respectively, within the inner circumference of the primary combustion chamber at spaced apart locations along the length of the chamber are provided to increase the diameter of the first section to the diameter of the refractory-lined section. The first of these bevels forms an angle of about 45 degrees with the longitudinal centerline of the annular primary combustion chamber, while the second beveled surface forms an angle of about 15 degrees with the longitudinal centerline. Each bevel is oriented such that there is an increase in the circumference of the inner circumference of the first section 182 in the direction of the flow of the coal-air mixture along the first section, thereby resulting in a two-step expansion of the volume of the first section and a corresponding decrease in the velocity of the coal-air mixture.

Downstream of the first section 182 of the primary combustion chamber 184 there is provided an tubular refractory lining 52 for the firetube 50. This lining defines a second section 198 of the primary combustion chamber and it is within this second section that there occurs a majority of the combustion of the coal. In a preferred embodiment, the refractory lining extends from the inlet nozzle 70 along the length of the firetube to approximately the midpoint of the length of the firetube.

In operation of the present system, finely divided coal from a storage hopper is fed via a gyratory feeder through a fluidized plenum to a conveyor device such as a feed screw which, in turn, moves the coal along the length of a coal delivery tube to the terminus of the delivery tube. Motive air from a source is caused to flow past the terminus of the coal delivery tube at high velocity to induce a vacuum at the terminus and thereby draw coal from the delivery tube into a mixing zone. The flowing mixture of coal and air is accelerated to supersonic velocity while the static pressure of the mixture is increased to the static pressure of the combustion chamber of the system. Within the combustion chamber, the initial mixture of coal and air has added thereto primary combustion air sufficient only to develop a reducing environment within the primary combustion chamber. For example, the quantity of motive air and primary combustion air, combined, is selected to develop a stoichiometry of about 0.55 within the primary combustion chamber. By this means, the formation of nitrogen oxides within the combustion chamber is minimized, while there is optimization of the combustion of the carbon in the coal. Adjacent the downstream end of the primary combustion chamber, secondary combustion air is introduced to the combustion chamber, preferably in the form of a series of circumferentially disposed and angled jets such that the secondary air entering the combustion chamber generates a counter swirl which both stabilizes the combustion flame, and enhances mixing of the secondary air with the combustion flame while reducing the extent to which the secondary combustion air advances in a direction reverse of the direction of the combustion flame. This secondary combustion air importantly functions to increase the stoichiometry of the combustion chamber to about 1.20 thereby developing an oxidative environment which functions to destroy nitrogen oxides which might have been formed during the combustion of the coal.

In a specific embodiment of the present apparatus, a 200 lb Cleaver-Brooks firetube boiler, which originally was designed to be fueled with gas or oil was retrofitted in accordance with the concepts of the present invention. This boiler, as originally designed is depicted in FIGS. 1 and 2A-2D .

The initial steps in retrofitting the boiler in question included removal of the original burner and the substitution therefor of an eductor designed in accordance with the present invention, and the provision of a refractory lining to the interior of the firetube to isolate the combustion flame from the metal wall of the firetube.

Figure 6A:
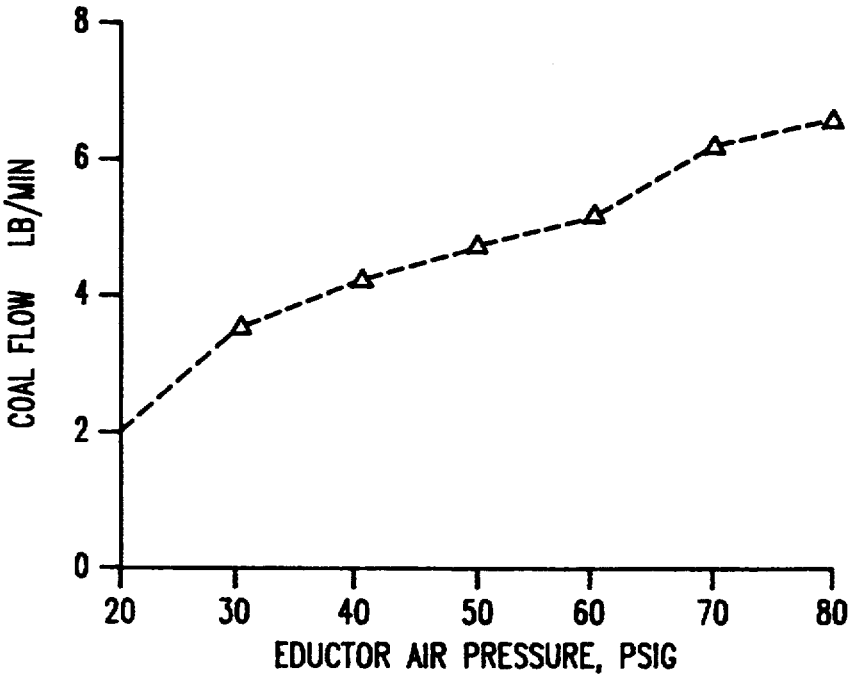
FIGS. 6A and 6B are graphs depicting the coal flow rate and vacuum, respectively, at the feed line exit from the coal storage system depicted in FIG. 4 versus the eductor motive air pressure.
Figure 6B:
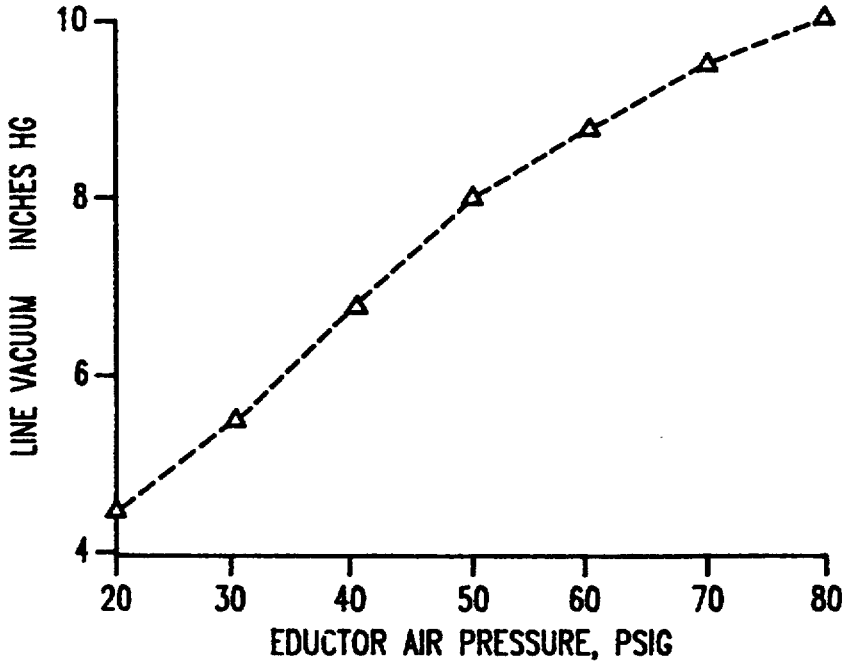

The eductor employed in this retrofitting was of the type depicted in FIG. 5. Specifically, the coal delivery tube 152 was of 0.50 inch O.D.×0.43 inch I.D. The annular spacing between the terminus of the coal delivery tube and the throat of the eductor was 0.030 inch. High pressure motive air at a pressure of between about 20 and 80 psig was introduced via the passageway 166 and upon passing through the annular spacing 162 was elevated to sonic velocity and developed a vacuum of between about 4.5 and 10.0 inches Hg at the terminus of the coal delivery tube. FIG. 6B presents a graph which shows the relationship of the vacuum to the motive air pressure. Static pressure in the suction area of the eductor ranged from about 9 psia to 12 psia, depending on the driving air pressure and coal flow rate. For a given driving air pressure and coal flow rate, the suction pressure is constant, so for a coal feed line with repeatable pressure drop characteristics, the coal flow rate can be controlled by varying the driving air pressure. In the present system, reliable control of coal flow rate was achieved over a range from 2.0 to 6.5 lb/min by varying the motive air pressure as further shown in FIG. 6A. Under other conditions of operation, firing rates that exceeded 6,000,000 Btu per hour were achieved.

Concurrent burner performance (turndown ratio) exceeded the range of 3.25 to 1, thereby exceeding the goal of 3 to 1 for turndown. The following Table I shows a 3.29 turndown ratio measured with 3 scfh of fluidizing nitrogen in the plenum of the coal storage unit and Upper Elkhorn No. 3 coal:

TABLE I

| Motive Air Pressure, psig | Motive Air Flow Rate, lb/min | Coal Flow Rate, lb/min | Coal Firing Rate, Btu/h |
|---|---|---|---|
| 80 | 6.58 | 6.52 | 5,868,000 |

TABLE I-continued

| Motive Air Pressure, psig | Motive Air Flow Rate, lb/min | Coal Flow Rate, lb/min | Coal Firing Rate, Btu/h |
|---|---|---|---|
| 20 | 2.43 | 1.98 | 1,782,000 |

In the present invention, the arrangement of the coal feed system is deemed of importance for proper operation of the eductor coal feed system. The feed system is designed to supply coal at the inlet end of the coal delivery tube at a uniform density and pressure. As depicted in FIG. 4 and described hereinabove, the coal feed system includes a hopper, a gyrating bin discharger and a fluidized discharge plenum. The gyrating bin discharger keeps coal flowing smoothly from the large hopper into the plenum. A pressure cone in the bin discharger supports the weight of the coal above the entrance of the discharge plenum, thus maintaining a relatively constant pressure head in the discharge plenum. The discharge plenum may consist of a 12 inch diameter tube with a fluidizing gas, such as nitrogen, being admitted to the plenum at the bottom thereof. The contents of the hopper are not fluidized. This arrangement assures that coal cannot pack at the entrance of the coal delivery tube, which would result in erratic coal flow and would eventually lead to line plugging. The fluidizing gas in the present example amounted to about 0.2 percent by weight of the coal flow. An auger located at the inlet to the coal delivery tube served to break up any lumps of coal before they entered the feed line. This auger, however, does not meter the flow of coal through the coal delivery tube. In the control of the flow of coal into the firetube, the control variable is eductor motive air pressure, which is maintained at a constant set point by a feedback control loop.

The system of the present invention provides advantages over the prior art pressurized coal delivery systems in that there is eliminated the need for a large pressurized coal storage tank or an airlock system. Further there is no need for the prior art control valve in the coal feed line for regulating the flow of coal. Such a valve creates a restriction in the flow area which is a source of plugging when feeding micronized material. Still further, the vacuum feed of the present system tends to pull any lumps of packed coal apart and keep the coal flowing at a constant rate, whereas the pressurized systems of the prior art tend to merely compact the material further. Possibly most importantly, the present vacuum system has been found to enhance the premixing of the coal and combustion air and thereby enhance the efficiency of the combustion performance significantly.

In a boiler retrofitted in accordance with the present concepts, initiation of coal combustion may be by means of a propane pilot (not shown in the Figures). Preferably, the refractory liner is preheated prior to initiation of the coal combustion, such preheating serving to reduce the formation of soot in the tubular refractory lining. No propane is used when the coal is being combusted and no preheating of the combustion air is required.

To alleviate adverse effects upon the boiler operation by reason of soot or ash buildup within the firetube 50, the end cap 46, and in the tubes, 94, 96 and 98, sootblowers were installed on the Cleaver-Brooks firetube boiler for cleaning the individual boiler tubes in the second, third and fourth passes. These sootblowers were installed at the pass 1-2, 2-3 and 3-4 turn-around areas. A sootblowing lance which was insertable at the exit end of the main firetube (pass 1) as also installed to remove deposits from the firetube walls. Scrapers were installed at the pass 1-2 turnaround area to remove deposits from the refractory lining in the endcap and the tube sheet at the entrance of the second pass tubes.

The sootblowers for the individual boiler tubes consist of ¼ inch o.d.×0.035 inch wall stainless steel tubes which are directed toward the upstream end of each boiler tube in the second, third, and fourth passes. The second pass had 46 tubes; the third and fourth passes each had 30 tubes. The sootblower tubes are connected to three separate headers on the second pass, in groups of 16, 15 and 15. The sootblowing medium is 120 psi nitrogen, but compressed air could be used for commercial retrofits. The tubes in the second pass were type 310 stainless steel, which demonstrated good corrosion resistance in the firetube exit area. The tubes on the other passes were type 316 stainless steel. In order to install the sootblowers on the second and fourth passes, it was necessary to drill an individual hole for each tube through the boiler end bell and the refractory inside, as there was no room for headers inside the boiler. The third pass installation was much simpler, because there was room for an internal header. The sootblowers were operated during the combustion tests and were effective in removing dust from the boiler tubes.

The first-pass firetube sootblower lance consisted of a ½ inch schedule 40 carbon steel pipe. The end of the pipe was welded shut and two opposed 7/16 inch diameter holes near the end of the pipe directed compressed nitrogen toward the firetube walls. The lance was operated in a manner similar to a typical retractable sootblower. It was slowly rotated as it was inserted into the firetube and nitrogen flow was maintained for the entire time it was inserted to prevent overheating. The lance was inserted to a depth slightly downstream of the station of the secondary air jets, and then retracted. The sootblower lance was operated during the tests and was effective in removing deposits from the firetube walls and maintaining heat transfer and exit gas temperatures.

The deposit scrapers at the pass 1-2 turnaround area were constructed from ½ inch o.d.×0.125 inch wall stainless steel tubing. The scrapers were located so they could be rotated across the surface of the refractory lining in the endcap or across the tube sheet. The scrapers were permanently installed inside the boiler; a small continuous flow of cooling air was passed through the tubing to keep the metal temperature at an acceptable level. The scrapers were operated during the tests, and were effective in removing deposits from the refractory and tube sheet.

Tests of the retrofitted 200 bhp Cleaver-Brooks firetube boiler. Three coals were used. These coals, and their properties are identified in Table II.

TABLE II

| | Coal Analyses | | |
|---|---|---|---|
| | Fuel Sample | | |
| | UE3, Medium Ash | UE3, High Ash | Illinois No. 6, available MDH coal |
| Identification | Standard DOE test fuel used for contract; Dry, ultra-fine coal; Medum ash content; High ash-fusion temperature | Dr, ultra-fine coal High ash content; High ash-fusion temperature | UTSI finely, pulverized; Very high ash content; Very low ash-fusion temperature |
| Ash % as fired | 2.4 | 6.5 | 11.4 |
| Moisture % as-fired | 0.9 | 0.9 | 3.1 |
| Sulfur % as-fired | 0.6 | 0.7 | 3.1 |
| Nitrogen % as-fired | 1.5 | 1.5 | 1.3 |
| Volatile Matter % as-fired (VM) | 36.9 | 35.1 | 36.8 |
| High Heating Value Btu/lb as-fired | 14,780 | 13,800 | 11,740 |
| Minimum Ash Fusion Temperature, °F. | 2,500 | 2,500 | ≦2,100 |
| Lb-Coal/MBtu | 67.7 | 72.5 | 85.2 |
| Lb-Ash/MBtu | 1.6 | 4.7 | 9.7 |
| Lb-S/MBtu | 0.4 | 0.5 | 2.6 |
| Lb-N/MBtu | 1.0 | 1.1 | 1.1 |
| Lb-VM/MBtu | 25.0 | 25.4 | 31.4 |
| Elemental ash analysis: | | | |
| $SiO_2$ | 45.5 | 51.7 | 42.5 |
| $Al_2O_3$ | 30.8 | 33.4 | 16.1 |
| $Fe_2O_3$ | 11.3 | 5.6 | 17.2 |
| $TiO_2$ | 1.6 | 1.6 | 0.7 |
| CaO | 1.8 | 2.0 | 3.6 |
| MgO | 1.11 | 0.9 | 0.7 |
| $Na_2O$ | 1.9 | 0.6 | 0.3 |
| $K_2O$ | 2.4 | 2.3 | 9.4 |
| $SO_3$ | 2.5 | 2.1 | 8.6 |
| $CR_2O_3$ | 0.1 | 0.1 | 0.1 |
| $P_2O_5$ | 0.5 | 0.2 | 0.4 |
| Median Particle Diameter, μm | 9 | 9 | 39 |
| DRY BASIS: | | | |
| Proximate | | | |
| Ash | 2.4 | 6.6 | 11.8 |
| Volatile Matter | 37.2 | 35.4 | 38.0 |
| Fixed Carbon | 60.4 | 58.0 | 50.2 |
| Ultimate | | | |

TABLE II-continued

| | Coal Analyses | | |
|---|---|---|---|
| | Fuel Sample | | |
| | UE3, Medium Ash | UE3, High Ash | Illinois No. 6, available MDH coal |
| Ash | 2.4 | 6.6 | 11.8 |
| Carbon | 83.2 | 79.4 | 66.0 |
| Hydrogen | 5.5 | 5.3 | 4.5 |
| Nitrogen | 1.5 | 1.5 | 1.3 |
| Sulfur | 0.6 | 0.7 | 3.2 |
| Oxygen by Difference | 6.8 | 6.5 | 13.2 |
| Btu/lb. HHV | 14,910 | 13,930 | 12,120 |

During testing of the retrofitted 200 bhp Cleaver-Brooks boiler, $NO_x$ emissions of 0.44 lb/MBtu were achieved using standard micronized Upper Elkhorn No. 3 coal with about 2.4% ash, at a firing rate of 3.6 MBtu/h. Carbon burnout was 99.1%. The maximum design firing rate for the 200 bhp Cleaver-Brooks boiler is 8.3 MBtu/h for natural gas of fuel oil firing; however, using the two-stage burner described hereinabove with coal firing produced a flame that was longer than the 15-foot firetube when the firing rate was much greater than 6 MBtu/h. Therefore, 6 MBtu/h was the maximum firing rate of this boiler during normal operation on coal.

Figure 11:
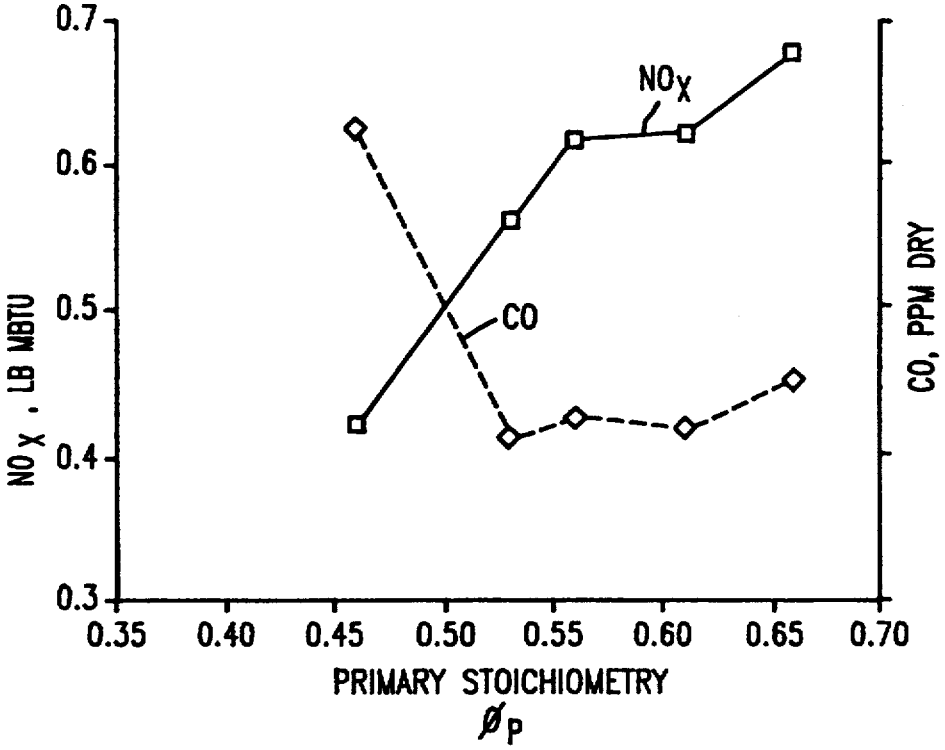
FIG. 11 is a graph depicting $NO_x$ and CO emissions versus primary stoichiometry.

$NO_x$ and CO emissions were found to be very sensitive to primary zone stoichiometry, $\Phi_p$. As shown in FIG. 11 $NO_x$ emission increases with increasing $\Phi_p$ in the range from 0.45 to 0.65. CO emission remains relatively constant at 20 to 30 ppm as $\Phi_p$ decreases from 0.65 to about 0.55, then increased rapidly as $\Phi_p$ drops below 0.55. It was found that CO emission must be maintained at about 40 ppm or lower in order to achieve carbon burnout efficiency near 99 percent. Thus, a primary combustion zone stoichiometry of 0.55 was found to provide the best combination of combustion efficiency and low $NO_x$ emission. This value for $\Phi_p$ also corresponds roughly to the lowest stoichiometry at which enough oxygen is available in the primary combustion zone to convert all carbon to CO. In a preferred combustor configuration, about 12 percent of the combustion air enters through the eductor, about 33 percent enters through the primary air swirler, and the remaining 55 percent enters through the secondary air jets. Burner operation was stable with a final stoichiometry, $\Phi_f$ down to about 1.10; however $\Phi_f$ was maintained at about 1.20 during normal operation to maximize carbon burnout.

Figure 9:
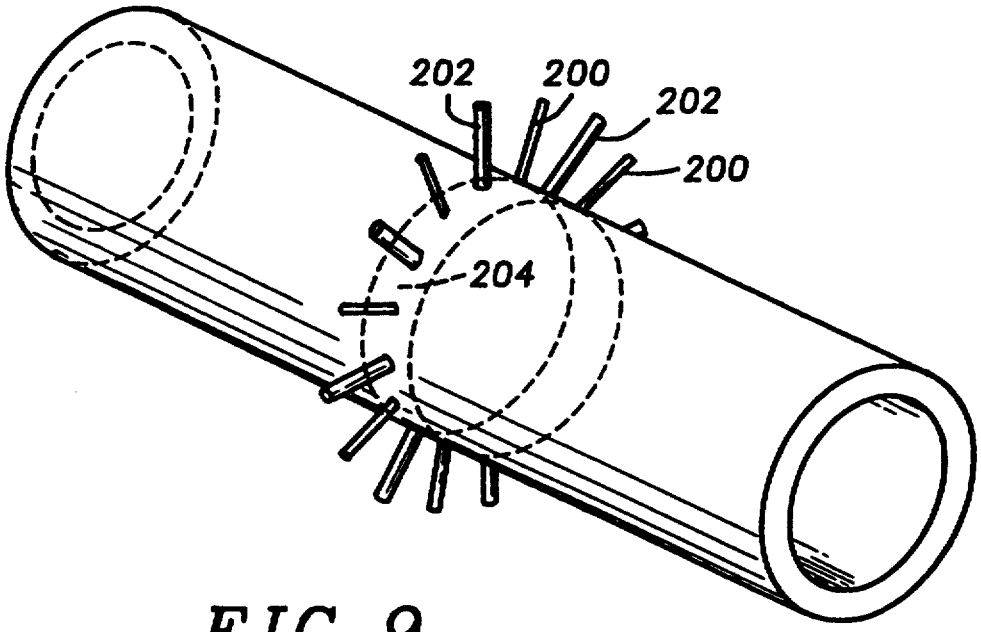
FIG. 9 is a schematic representation of a firetube which is provided with auxiliary circumferential jets for injecting a gaseous fuel or supplementary combustion agent to the interior of the firetube at a location disposed approximately halfway along the length of the firetube.
Figure 10:
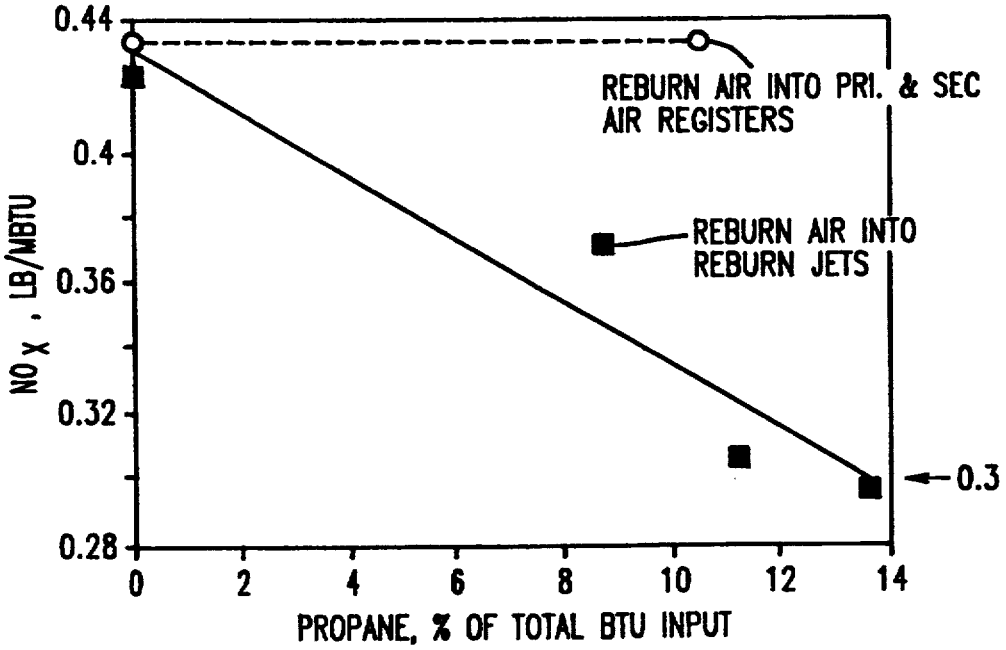
FIG. 10 is a graph comparing the $NO_x$ emissions from a retrofitted firetube boiler with and without reburning capabilities.

In accordance with one aspect of the present invention, reduction of the emission of $NO_x$ is accomplished to a lower level, than that achieved in the two-stage burner. This was accomplished by establishing a third combustion zone 204 (see FIG. 9) in the approximate midpoint of the length of the refractory lining by introducing into the firetube propane or natural gas through a series of jets 200 disposed about the circumference of the firetube. Optionally, alternating ones 202 of these jets was used in inject combustion air into the firetube, along with the propane or natural gas. FIG. 8 presents the results of tests of a boiler equipped to provide the third combustion zone (i.e., reburning).

In this latter three-stage burner configuration, it was found that addition of the additional "reburn" combustion air at either the primary or secondary combustion air inlets did not result in reduced $NO_x$ emission, even though the propane or natural gas was admitted to establish the third stage of combustion. On the other hand, when the reburn air was added at the same plane as the propane or natural gas, the stoichiometry can be maintained near the optimum value throughout the primary combustion chamber, and a significant reduction in $NO_x$ resulted. For example, a reduction in $NO_x$ emission from about 0.42 lb/MBtu to about 0.30 lb/MBtu was achieved with 13.7 percent of the heat input, as a percentage of the total coal+propane heat input, from propane.

Still further tests were conducted of the retrofitted 200 HP Cleaver-Brooks boiler using dry, ultra fine (8 micrometer median particle diameter) high ashfusion Upper Elkhorn #3 coals with 2.4 and 6.6 percent ash (DUC's), and a sample of low ash-fusion coal with 11.4 percent ash which was finely pulverized to 39 micrometer median particle diameter. The results of these tests are given in Table III.

TABLE III

| | Goal | Accomplishment |
|---|---|---|
| Combustion Efficiency | >99.0 | 99.3 |
| Boiler Efficiency | >80.0 | 86.5 |
| Burner Turndown Ratio | >3.1 | >3.5:1[1] |
| Emissions, pounds per million | Btu | |
| $SO_2$ | <1.2 | 0.81 |
| $NO_x$ | <0.7 | 0.53; <0.3[2] |
| Particulates | <0.6 | <0.05 |
| Support Fuel | None | None |
| Air Preheat | None | None |

[1]Without using any support fuel or preheating the combustion air.
[2]With propane reburning supplying 14% of the Btu input.

Figure 12:
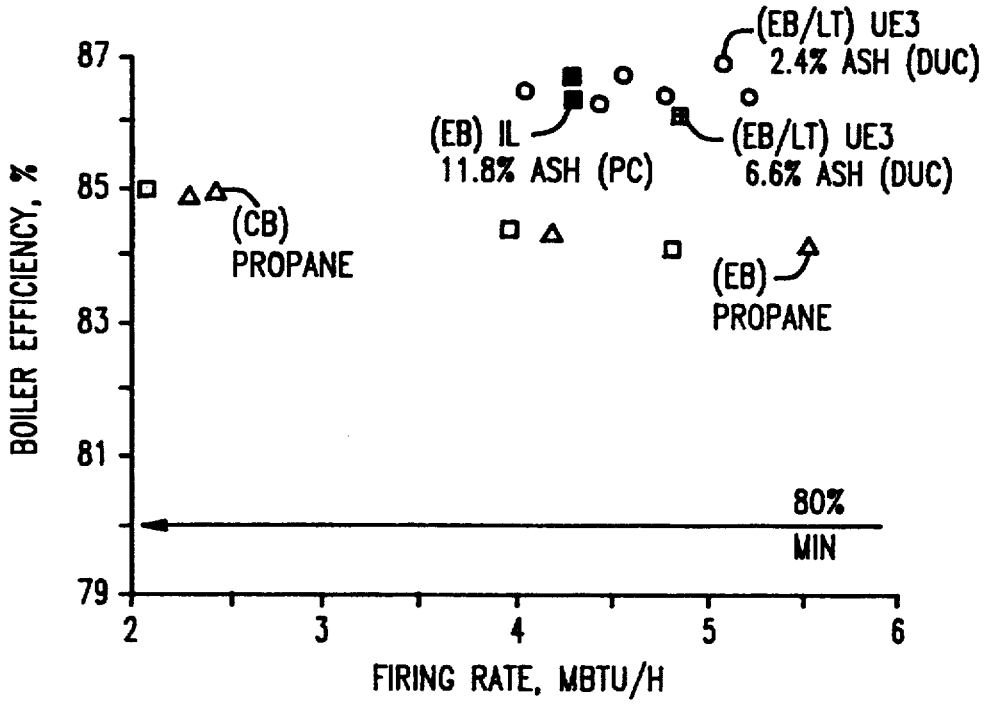
FIG. 12 is a graph depicting boiler efficiencies versus firing rates for various fuels.

From Table III, it will be noted that these further tests resulted in greater than 80 percent boiler efficiency, greater than 99 percent combustion efficiency, less than 1.2 lbs of $SO_2$ emissions per million Btu burner input, less than 0.7 lb $NO_x$ emissions per million Btu burner input, and less than 0.6 lb of particulate emissions per million Btu burner input, thereby meeting, and in all cases exceeding, the goals set for the system. Boiler efficiencies measured during these tests are given in graph format in FIG. 12. These boiler efficiencies were calculated using the American Boiler Manufacturers Association (ABMA) method. Boiler efficiencies were between 86 and 87 percent during all the tests. Boiler efficiencies for propane firing are also plotted in FIG. 12 for the retrofitted burner (EB), and the original Cleaver-Brooks burner (CB). Boiler efficiencies for propane firing were very similar for the retrofitted burner and the original Cleaver-Brooks burner.

Figure 13:
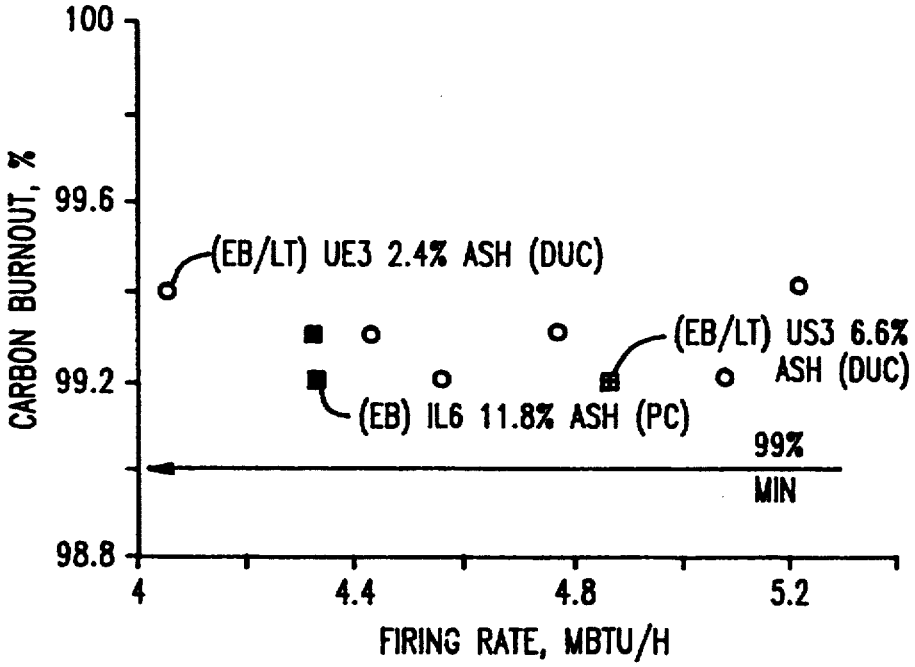
FIG. 13 is a graph depicting carbon burnout values versus firing rate for various coals.

Carbon conversion efficiencies measured during these tests are plotted as a function of average firing rate in FIG. 13. Carbon conversion efficiencies were between 99.2 and 99.4 percent during the tests. Carbon burnout for the finely-pulverized Illinois No. 6 coal was similar to the ultra-fine UE3 coals, even though the mean particle diameter of the Illinois No. 6 was much larger (39 micrometer versus 9 micrometer) thereby indicating that expensive micronizing is not required in order to achieve a high carbon conversion efficiency in a retrofitted boiler.

Figure 14:
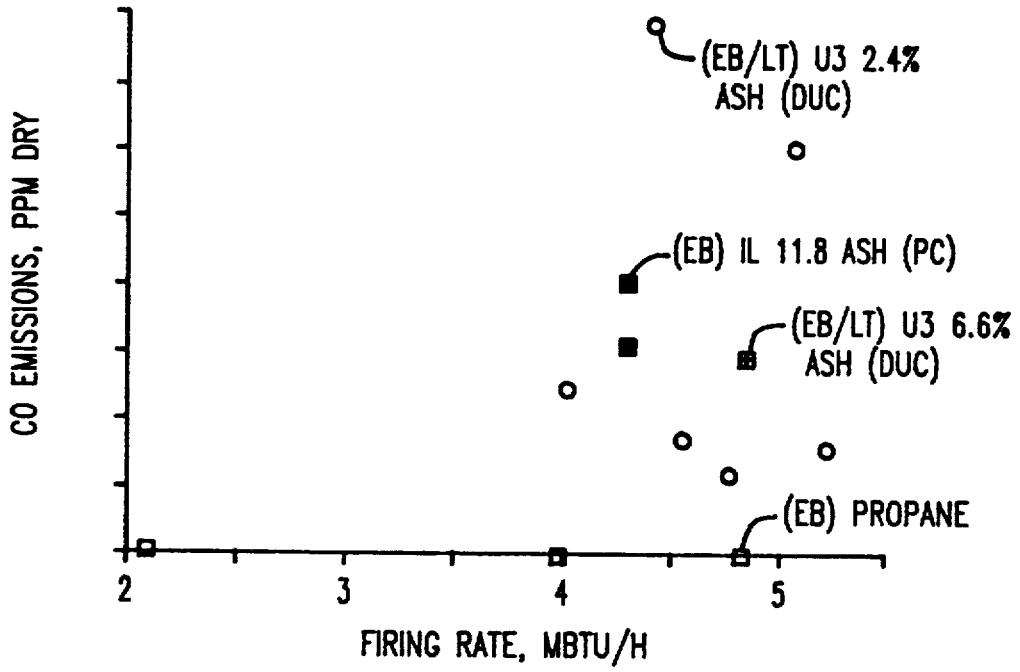
FIG. 14 is a graph depicting typical CO emissions versus firing rate for various fuels.

Carbon monoxide (CO) emissions during these tests are plotted as a function of average firing rate in FIG. 14. CO emissions were typically less than 60 PPM. The higher CO emissions measured during two of the tests were caused by ash deposits at the firetube exit, which interfered with burner operation.

Sulfur dioxide ($SO_2$) emissions were limited to about 0.8 lb/MBtu during most of the tests due to the low sulfur content of the UE3 coals. Emissions while firing Illinois No. 6 were higher, indicating the desirability of using low-sulfur coals.

Figure 15:
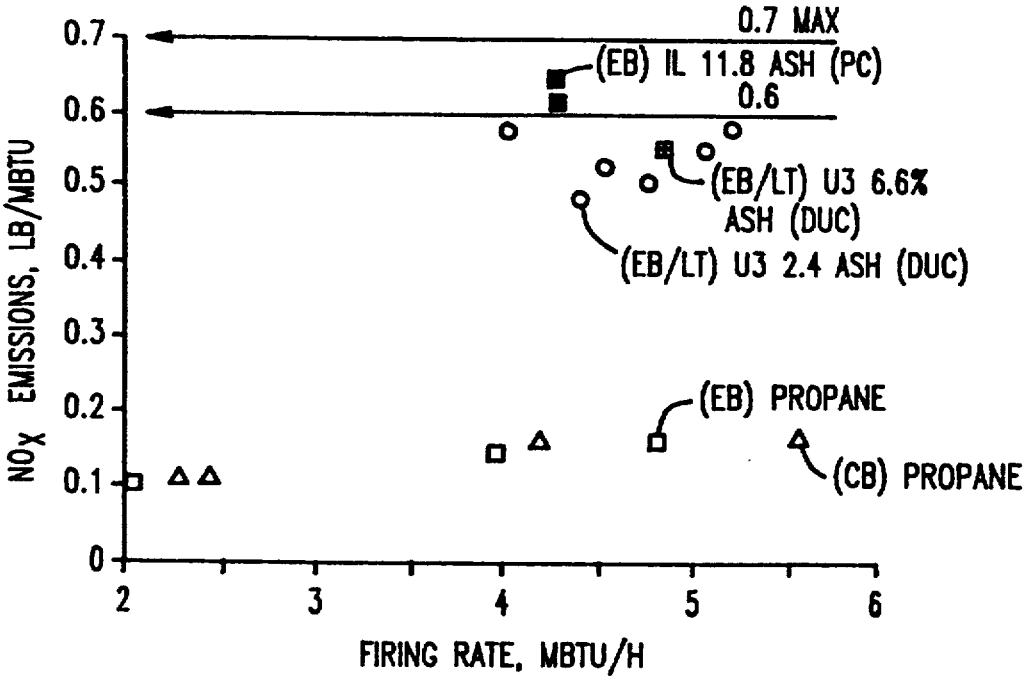
FIG. 15 is a graph depicting $NO_x$ emissions versus firing rate for various fuels.

$NO_x$ emissions measured during the tests are plotted as a function of firing rate in FIG. 15. $NO_x$ emissions were less than 0.6 lb/MBtu during all of the tests when UE3 coals were fired. Emissions were slightly above 0.6 lb/MBtu when Illinois NO. 6 was fired. As noted hereinabove, $NO_x$ emission is strongly dependent on primary stoichiometry. Carbon conversion efficiency suffers if the primary stoichiometry drops much below 0.55. Reburning using propane or natural gas to establish a third combustion zone may be used to both reduce the $NO_x$ emissions and obtain high carbon conversion efficiency. $NO_x$ emission levels below about 0.4 lb/MBtu can be achieved with reburning.

Dust emission rates indicated that the flyash produced by combustion of micronized UE3 coal is not particularly difficult to collect. Extrapolation of the test data indicates that a steady state pressure drop of about 2.5 inches of water could be maintained at a filtration velocity of 3 ft/min, or about 4 inches of water at 4 ft/min. Standard woven fiberglass bag material performs adequately in the retrofitted boiler application.

In terms of the cost of steam generated, the retrofitted boiler of the present invention, using finely pulverized coal substituted for propane represents an annual savings in excess of $50,000 for the same steam production employing a 200 bhp firetube boiler.

What is claimed:

1. A method for converting a gas-fired firetube boiler used for converting water to steam by circulating the water past a plurality of tubes contained within said boiler and through which heated gases are flowed, to a coal-fired firetube boiler wherein the coal is combusted within said firetube to develop a flame that extends along the length dimension of said firetube, comprising the steps of providing said firetube with eductor means adjacent the inlet end thereof, said eductor including a coal delivery tube having inlet and outlet open ends, and a motive air flow passageway disposed concentric of said delivery tube, feeding to said eductor a constant stream of dense finely divided coal such that said coal is available at the outlet end of said coal delivery tube, feeding to said eductor pressurized motive air, said motive air being directed past said outlet end of said coal delivery tube at high velocity to thereby develop a vacuum in the vicinity of said outlet end of said coal delivery tube whereby finely divided coal is withdrawn from said delivery tube and mixed with said motive air, introducing to said mixture of coal and air a quantity of primary combustion air at a location adjacent the inlet end of said firetube whereby there is developed a primary combustion zone adjacent the inlet end of said firetube, said primary combustion air passing through angled vane means disposed about the circumference of said firetube such that there is imparted to the flame developed by combustion of said coal-air mixture a first swirl pattern having a first direction, providing said firetube with a refractory lining which extends substantially from the inlet end of said firetube along the length of said firetube to a location approximately midway of said firetube, providing at least one passageway for the flow of secondary combustion air along the length of said firetube between said refractory lining and said firetube from a location adjacent the inlet end of said firetube to a location adjacent the outlet end of said firetube, providing a plurality of jets in fluid communication with said passageway and extending through the thickness of said refractory lining to provide passageways for combustion air from said passageway into the interior of said firetube whereby there is developed a secondary combustion zone within said firetube, orienting said jets at an angle with respect to the diameter of said firetube such that combustion air entering said firetube through said jets develops a second swirl pattern having a second direction, said second direction being opposite in direction to said first swirl pattern.

2. The method of claim 1 and including the step of monitoring the oxygen content of the flue gases exiting said boiler to develop a signal, and directing said signal to a control means for controlling the quantity of primary combustion air to said firetube as a function of the presence of oxygen in said flue gases.

3. The method of claim 1 and including the step of dividing the combustion air employed in combusting the coal within said firetube into multiple streams, the first of which comprises the motive air, the second of which comprises the primary combustion air, and the third of which comprises the secondary combustion air.

4. The method of claim 3 and including the steps of limiting the quantity of motive air to about 15% of the stoichiometric quantity of air required for substantially complete combustion of coal being fed into the boiler, limiting the quantity of primary combustion air to about 33% of said stoichiometric quantity of air, and limiting the quantity of secondary combustion air to about 55% of said stoichiometric quantity of air.

5. The method of claim 1 and including the step of introducing a gaseous fuel and combustion air into the interior of said firetube at a location approximately halfway from either of the inlet and outlet ends of said firetube to establish a third combustion zone at this halfway location.

6. A firetube boiler comprising a housing, a firetube disposed within said housing and having open inlet and outlet ends, refractory means extending from the inlet through the midpoint of the interior wall of said firetube, an inlet nozzle disposed at said inlet end of said firetube, said inlet nozzle including eductor means which includes a coal delivery tube and means defining an annular air flow passageway disposed concentrically about said delivery tube, said coal delivery tube having an open outlet end terminating within said inlet nozzle and being spaced annularly from the interior wall of said inlet nozzle to define therebetween an annulus through which motive air from a source may be caused to flow, a source of pressurized motive air, means placing said source of motive air in fluid-flow communication with said annular flow passageway whereby said motive air is caused to flow through said passageway thence through said annulus and past said outlet end of said delivery tube to develop a vacuum at said outlet end of said delivery tube and thereby draw finely divided coal from said delivery tube and effect mixing of said withdrawn coal and said motive air, means introducing primary combustion air to said mixture of coal and motive air to develop within said firetube a primary combustion zone within which there is developed a combustion flame which propagates along the length of said firetube, means defining an air flow passageway between said refractory lining and said firetube, said passageway extending from a location adjacent said inlet end of said firetube along the length of said firetube to a terminal location adjacent the outlet end of said firetube, means defining a plurality of air flow passageways through the thickness of said refractory lining from the terminal location of said passageway to the interior of said firetube, means introducing secondary combustion air through said passageway between said refractory lining and said firetube, thence through said plurality of passageways through the thickness of said refractory lining to develop a second combustion zone within said firetube.

7. The boiler of claim 6 and including means controlling the introduction of combustion air to said firetube, said means limiting the combined quantity of motive air and primary combustion air to about 55% of the stoichiometric quantity of combustion air required to combust the coal which is drawn into said firetube, and limiting the quantity of secondary combustion air to that quantity which will establish an overall stoichiometry of the combustion reaction within the firetube to about 1.20.

8. A method for firing a boiler of the firetube type with coal comprising the steps of introducing into the firetube of the firetube boiler a refractory liner which extends from a location adjacent the inlet end of the firetube to a location approximately midway between the opposite ends of the firetube, providing eductor means having an open outlet end in communication with the inlet end of the firetube, providing a substantially constant supply stream of dense, finely divided coal to the eductor means and in position to be withdrawn from the outlet end thereof, defining a first combustion zone adjacent the inlet end of the firetube and downstream of the eductor means, defining a coal and air mixing region substantially upstream of the first combustion zone, supplying pressurized motive combustion air to the eductor in an annular flow pattern wherein the combustion air moves past the open outlet end of the eductor means at a flow rate sufficient to generate a vacuum in the region adjacent the outlet end of the eductor means, this vacuum being of a sufficient magnitude as causes coal to be withdrawn from the outlet end of the eductor and entrained in the flowing motive combustion air, the motive combustion air being of a quantity sufficient to supply approximately 15% of the desired total quantity of combustion air for combusting the coal within the length dimension of the firetube, directing the mixture of coal and air into a mixing chamber defined in the eductor means substantially immediately downstream of the outlet end of the eductor means, decreasing the flow rate of the coal and air mixture to reduce the static pressure thereof substantially to the desired static pressure of the mixture in the first combustion zone of the firetube, firing the coal and air mixture to generate a flame within the firetube, introducing to the first combustion zone a quantity of primary combustion air in a first swirl pattern to thereby enhance stabilization of the flame, introducing to the firetube at a location approximately midway between the opposite ends of the firetube a quantity of secondary combustion air in a second swirl pattern, the second swirl pattern being opposite in swirl direction to the first swirl pattern, the secondary combustion air generating a second combustion zone within the firetube at the approximate midpoint between the opposite ends of the firetube.

9. The method of claim 8 and including the step of subjecting the coal and air mixture to a series of shocks as the mixture flows from the outlet end of the eductor means and into the firetube.

10. The method of claim 9 and including the step of increasing the rate of flow of the motive pressurized air from a sonic or lesser velocity to a supersonic velocity in the course of the flow of the motive air past the outlet end of the eductor means.

11. The method of claim 9 and including the step of introducing supplemental gas or oil to the firetube at a location approximately halfway between the inlet end of the firetube and the location along the firetube at which the secondary air is introduced to the firetube.

12. The method of claim 9 including the step of adjusting the quantity of primary combustion air which is introduced to the firetube to about 23% of the stoichiometric quantity of combustion air required to effect the desired combustion of the coal and air mixture within the firetube.

13. The method of claim 9 including the step of adjusting the quantity of secondary combustion air which is introduced to the firetube to about 55% of the stoichiometric quantity of combustion air required to effect the desired combustion of the coal and air mixture within the firetube.

14. The method of claim 9 and including the step of adjusting the stoichiometry of the combustion reactions within the first combustion zone of the firetube to that which produces a stoichiometry of about 55 within the first combustion zone within the firetube.

15. The method of claim 9 and including the step of adjusting the stoichiometry of the combustion reactions within the secondary combustion zone of the firetube to that which produces an overall stoichiometry within the firetube of about 1.20.

16. The method of claim 9 and including the step of monitoring the oxygen content of the flue gases from the boiler, generating a signal which is representative of the oxygen content of the flue gases, and employing the signal to adjust the quantity of combustion air admitted to the firetube.

17. The method of claim 9 wherein the firetube boiler is initially designed to be fired with gas or oil and including the step of removing from the firetube the gas or oil burner thereof.

18. A method for converting a gas-fired firetube boiler used for converting water to steam by circulating the water past a plurality of tubes contained within said boiler and through which heated gases are flowed, to a coal-fired firetube boiler wherein the coal is combusted within said firetube to develop a flame that extends along the length dimension of said firetube, comprising the steps of providing said firetube with coal feed means adjacent the inlet end thereof, said coal feed means including a coal delivery tube having inlet and outlet open ends, feeding to said coal feed means a constant stream of dense finely divided coal such that said coal is available at the outlet end of said coal delivery tube, feeding to said coal feed means pressurized air, said air being directed past said outlet end of said coal delivery tube at high velocity whereby finely divided coal is mixed with said air, introducing to said mixture of coal and air a quantity of primary combustion air at a location adjacent the inlet end of said firetube whereby there is developed a primary combustion zone adjacent to the inlet end of said firetube, said primary combustion air passing through angled vane means disposed about the circumference of said firetube such that there is imparted to the flame developed by combustion of said coal-air mixture a first swirl pattern having a first direction, providing said firetube with a refractory lining which extends substantially from the inlet end of said firetube along the length of said firetube to a location approximately midway of said firetube, providing at least one passageway for the flow of secondary combustion air to a location adjacent the outlet end of said firetube, providing a plurality of jets in fluid communication with said passageway and extending through the thickness of said refractory lining to provide passageways for combustion air from said passageways into the interior of said firetube whereby there is developed a secondary combustion zone within said firetube, orienting said jets at an angle with respect to the diameter of said firetube such that combustion air entering said firetube through said jets develops a second swirl pattern having a second direction, said second direction being opposite in direction to said first swirl pattern.

19. The method of claim 18 and including the step of monitoring the oxygen content of the flue gases exiting said boiler to develop a signal, and directing said signal to a control means for controlling the quantity of primary combustion air to said firetube as a function of the presence of oxygen in said flue gases.

20. The method of claim 18 and including the step of dividing the combustion air employed in combusting the coal within said firetube into multiple streams, the first of which comprises the primary combustion air, and the second of which comprises the secondary combustion air.

21. The method of claim 20 and including the steps of limiting the quantity of primary combustion air to about 48% of the stoichiometric quantity of air required for substantially complete combustion of coal being fed into the boiler, and limiting the quantity of secondary combustion air to about 55% of said stoichiometric quantity of air.

22. The method of claim 18 and including the step of introducing a gaseous fuel and combustion air into the interior of said firetube at a location approximately halfway from either of the inlet and outlet ends of said firetube to establish a third combustion zone at this halfway location.

23. A firetube boiler comprising:

a housing, a firetube disposed within said housing and having open inlet and outlet ends, refractory liner extending from the inlet through the midpoint of the length of the interior wall of said firetube, said liner terminating at a downstream end, an inlet nozzle disposed at said inlet end of said firetube, said inlet nozzle including coal delivery tube means, a source of pressurized combustion air, and means introducing primary combustion air to said coal to develop within said firetube a primary combustion zone within which there is developed a combustion flame which propagates along the length of said firetube, an air flow passageway extending from the inlet end of said firetube to a terminating location adjacent the downstream end of said liner, means defining a plurality of air flow passageways, through the thickness of said refractory lining from the terminal location of said passageway to the interior of said firetube, means introducing secondary combustion air through said passageway thence through said plurality of passageways through the thickness of said refractory lining to develop a second combustion zone within said firetube.

24. The boiler of claim 23 and including means controlling the introduction of combustion air to said firetube, said means limiting the combined quantity of primary combustion air to about 55% of the stoichiometric quantity combustion air required to combust the coal which is drawn into said firetube, and limiting the quantity of secondary combustion air to that quantity which will establish an overall stoichiometry of the combustion reaction within the firetube to about 1.20.

25. A method for firing a boiler of the firetube with coal comprising the steps of introducing into the firetube of the firetube boiler a refractory liner which extends from a location adjacent the inlet end of the firetube to a location approximately midway between the opposite ends of the firetube, providing coal feed means having an open outlet end in communication with the inlet end of the firetube, providing a substantially constant supply stream of dense, finely divided coal to the coal feed means and in position to be discharged from the outlet end thereof, defining a first combustion zone adjacent the inlet end of the firetube and downstream of the coal feed means, defining a coal and air mixing region substantially upstream of the first combustion zone, supplying pressurized combustion air to the coal feed means whereby the combustion air moves into the firetube and causes coal discharged from the outlet end of the coal feed means to be entrained in the flowing combustion air, the combustion air being of a quantity sufficient to supply approximately 55% of the desired total quantity of combustion air for combusting the coal within the length dimension of the firetube, directing the mixture of coal and air into a mixing a chamber defined in the firetube substantially immediately downstream of the outlet end of the coal feed means, decreasing the flow rate of the coal and air mixture to reduce the static pressure thereof substantially to the desired static pressure of the mixture in the first combustion zone of the firetube, firing the coal and air mixture to generate a flame within the firetube, introducing to the first combustion zone a quantity of combustion air in a first swirl pattern to thereby enhance stabilization of the flame, introducing to the firetube at a location proximate to the outlet end of the firetube a quantity of secondary combustion air in a second swirl pattern, the second swirl pattern being opposite in swirl direction to the first swirl pattern, the secondary combustion air generating a second combustion zone within the firetube at a location proximate to the outlet end of the firetube.

26. The method of claim 25 and including the step of subjecting the coal and air mixture to a series of shocks as the mixture flows from the outlet end of the coal feed means and into the firetube.

27. The method of claim 25 and including the step of increasing the rate of flow of the pressurized combustion air from a sonic or lesser velocity to a supersonic velocity in the course of the flow of the air past the outlet end of the coal feed means.

28. The method of claim 25 and including the step of introducing supplemental gas or oil to the firetube at a location approximately halfway between the inlet end of the firetube and the location along the firetube at which the secondary air is introduced to the firetube.

29. The method of claim 25 including the step of adjusting the quantity of primary combustion air which is introduced to the firetube to about 55% of the stoichiometric quantity of combustion air required to effect the desired combustion of the coal and air mixture within the firetube.

30. The method of claim 25 including the step of adjusting the quantity of secondary combustion air which is introduced to the firetube to that quantity which will establish an overall stoichiometry of the combustion of reaction within the firetube to about 1.20.

31. The method of claim 25 and including the step of monitoring the oxygen content of the flue gases from the boiler, generating a signal which is representative of the oxygen content of the flue gases, and employing the signal to adjust the quantity of combustion air admitted to the firetube.

32. The method of claim 25 wherein the firetube boiler is initially designed to be fired with gas or oil and including the step of removing from the firetube the gas or oil burner thereof.

33. A burner for a boiler, said burner exhibiting enhanced efficiency of combustion of fuel and low generation of $NO_x$ compounds in the course of combustion of said fuel and comprising a source of combustion air, a source of pulverized coal, means defining a generally tubular combustion chamber having first and second ends, one of said ends defining an inlet section of said combustion chamber and the other end being open and defining an outlet of said combustion chamber, means directing said coal to said combustion chamber, means directing said combustion air to said chamber in at least two separate streams, a first one of said streams entering said combustion chamber at a location associated with the location of admission of said coal to said combustion chamber and another of said streams entering said combustion chamber at a location spaced-apart from said first one of said streams and downstream of said location of admission of said coal to said combustion chamber, means for selecting the respective volumes of each of said first and said another of said streams of combustion air to values which develop a combustion environment which is substoichiometric with respect to the quantity of combustion air relative to the quantity of fuel in said stream in the vicinity of said inlet end to said combustion chamber and a stoichiometric combustion environment in the vicinity of said outlet end of said combustion chamber which is adequate to develop an overall combustion environment which is substoichiometric with respect to the quantities of combustion air relative to the quantity of fuel in said combustion chamber, means associated with said combustion chamber for imparting a swirling motion to said coal and said first stream of said combustion air admitted to said combustion chamber, means associated with said combustion chamber for imparting a swirling motion to said another stream of combustion air as it enters said combustion chamber at said spaced-apart location, said direction of swirl of said another stream of combustion air being counter to the direction of swirl of said coal and first stream of combustion air, and means defining an elongated tubular section of said burner which extends from downstream of said location of introduction of said coal and said first stream of combustion air to said combustion chamber, said tubular section defining an elongated path along which the coal and first stream of combustion air move and along which the coal is combusted, the overall length of said combustion chamber being such that substantially all of said coal admitted to said combustion chamber is combusted prior to reaching the outlet end of said combustion chamber.

34. The burner of claim 33 wherein said tubular section is of a refractory material.

35. The burner of claim 33 and including means for introducing a gaseous fuel to said burner at a location intermediate said inlet and outlet ends of said burner.

36. A burner for use in a firetube boiler comprising:

a. an eductor comprising a coal delivery tube having an open outlet end to which there may be delivered a constant stream of dense, finely divided coal;

b. an annular conduit disposed in concentric relationship with said outlet end of said delivery tube;

c. a source of compressed air;

d. a second conduit connecting said source of compressed air with said annular conduit whereby compressed air may be fed from said source, through said annular conduit, and past said outlet end of said delivery tube at a flow rate which develops a vacuum in the region adjacent said outlet end of said delivery tube, said vacuum capable of drawing coal from said delivery tube into the flowing stream of air passing said outlet end; and e. an inlet nozzle comprising a first chamber disposed to and downstream of said eductor and in fluid communication therewith, said first chamber capable of receiving flowing air and entrained coal, said first chamber including means for initially expanding a volume of air flowing through said chamber so as to mix air and coal to form a combustible mixture, and said first chamber further including means for further expanding the volume of said mixture to adjust the static pressure of said mixture to a value suitable for entry into a firetube.

* * * * *